US009774116B2

(12) United States Patent
Kang et al.

(10) Patent No.: US 9,774,116 B2
(45) Date of Patent: Sep. 26, 2017

(54) BOARD CONNECTOR HAVING A FIXING MEMBER WITH PLATE PIECES FACING EACH OTHER IN A PLATE THICKNESS DIRECTION

(71) Applicant: Sumitomo Wiring Systems, Ltd., Yokkaichi, Mie (JP)

(72) Inventors: Liping Kang, Mie (JP); Kenji Okamura, Mie (JP); Mitsugu Furutani, Mie (JP)

(73) Assignee: SUMITOMO WIRINF SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/350,173

(22) Filed: Nov. 14, 2016

(65) Prior Publication Data

US 2017/0162961 A1 Jun. 8, 2017

(30) Foreign Application Priority Data

Dec. 4, 2015 (JP) ..... 2015-237192

(51) Int. Cl.

| | |
|---|---|
| ***H01R 12/00*** | (2006.01) |
| ***H01R 12/70*** | (2011.01) |
| ***H01R 12/71*** | (2011.01) |
| ***H01R 43/02*** | (2006.01) |

(52) U.S. Cl.

CPC ..... *H01R 12/7082* (2013.01); *H01R 12/716* (2013.01); *H01R 43/0256* (2013.01)

(58) Field of Classification Search

CPC .... H01R 12/00; H01R 13/6595; H01R 13/73; H01R 43/025; H01R 43/0256

USPC ..... 439/82–83, 567–572

See application file for complete search history.

(56) References Cited

U.S. PATENT DOCUMENTS

| | | | | |
|---|---|---|---|---|
| 6,086,418 | A * | 7/2000 | Chang | H01R 13/73 439/567 |
| 6,123,580 | A * | 9/2000 | Bendorf | H01R 12/7029 439/329 |
| 6,343,951 | B1 * | 2/2002 | Ono | H01R 23/6873 439/108 |
| 6,371,802 | B1 * | 4/2002 | Smalley, Jr. | H01R 12/7023 439/567 |
| 7,001,212 | B1 * | 2/2006 | Juntwait | H05K 3/301 439/566 |
| 7,878,848 | B1 * | 2/2011 | Yang | H01R 12/7029 439/567 |

FOREIGN PATENT DOCUMENTS

| | | |
|---|---|---|
| JP | 2008-135314 | 6/2008 |

* cited by examiner

*Primary Examiner* — Chandrika Prasad
(74) *Attorney, Agent, or Firm* — Gerald E. Hespos; Michael J. Porco; Matthew T. Hespos

(57) ABSTRACT

A board connector includes a plate-like fixing member (30) to be mounted in a housing (10) and including a board fixing portion (31) to be fixed to a circuit board (100) by solder. At least the board fixing portion (31) of the fixing member includes a plurality of plate pieces (38A, 38B) arranged to face each other in a plate thickness direction. Plating layers (46) are formed on plate surfaces of the plate pieces (38A, 38B) and plating drip layers (43) continuous with the plating layers (46) are formed on end surfaces of the plate pieces (38A, 38B) intersecting with the plate surfaces.

5 Claims, 18 Drawing Sheets

BOARD CONNECTOR HAVING A FIXING MEMBER WITH PLATE PIECES FACING EACH OTHER IN A PLATE THICKNESS DIRECTION

BACKGROUND

1. Field of the Invention

The invention relates to a board connector.

2. Description of the Related Art

Japanese Unexamined Patent Publication No. 2008-135314 discloses a board connector that is to be mounted on a circuit board and includes a housing made of resin and a fixing member made of metal. The fixing member includes a housing mounting portion to be mounted in the housing and a board mounting portion to be mounted on the circuit board by solder.

The fixing member is punched out into a predetermined development shape from a metal plate, and plating layers can be formed on end surfaces (cut surfaces intersecting with plate surfaces) to improve solder wettability of the fixing member to the circuit board. However, post-plating costs are high, and it is desirable, if possible, to plate the metal plate before punching out (pre-plating). On the other hand, pre-plating leads to poor solder wettability since the plating layers cannot be formed on the end surfaces of the fixing member.

The invention was completed based on the above situation and aims to provide a board connector with a fixing member capable of improving solder wettability even if pre-plating is performed.

SUMMARY

The invention relates to a board connector with a housing into which at least one terminal fitting is to be mounted. A substantially plate-like fixing member is mounted in the housing and includes at least one board fixing portion to be fixed to a circuit board by solder. At least the board fixing portion of the fixing member includes plate pieces arranged to substantially face each other in a plate thickness direction. Plating layers are formed on plate surfaces of the plate pieces and plating drip layers substantially continuous with the plating layers are formed on end surfaces of the plate pieces that intersect the plate surfaces.

The plate pieces may be arranged at a distance from each other in the plate thickness direction. Solder adheres to the plating layers formed on both plate surfaces of the plate pieces so that solder wettability is improved.

The plate pieces may be coupled integrally or unitarily via a bend. According to this configuration, the number of components can be reduced and workability is improved. In addition, the plating layers also may be formed on curved surfaces of the bend to improve solder wettability further.

The plate pieces need not be provided in a part of the fixing member to be mounted in the housing. Thus, a formation range of the plate pieces can be suppressed to a minimum necessary range and material cost can be reduced.

The plating drip layers may be substantially continuous with the plating layers formed on the plate surfaces of the plate pieces substantially facing toward one side in the plate thickness direction. Accordingly, a separation distance between the plating drip layers between adjacent plate pieces can be shorter. A non-plated area can be made shorter so that solder wettability can be improved.

A conductive metal plate is punched out or cut into a predetermined shape after being plated (pre-plating). Thus, plating layers are formed on plate surfaces of the fixing member and plating drip layers continuous with the plating layers are formed on end surfaces of the fixing member. At least the board fixing portion of the fixing member includes the plurality of plate pieces arranged to substantially face each other in the plate thickness direction and the plating drip layers are formed on the end surfaces of the plate pieces. Thus, a plurality of the plating drip layers are formed in the plate thickness direction, and solder wettability can be improved by the adhesion of solder to each plating drip layer.

These and other features and advantages of the invention will become more apparent upon reading the following detailed description and accompanying drawings. Even though embodiments are described separately, single features thereof may be combined to additional embodiments.

DETAILED DESCRIPTION

Figure 2:
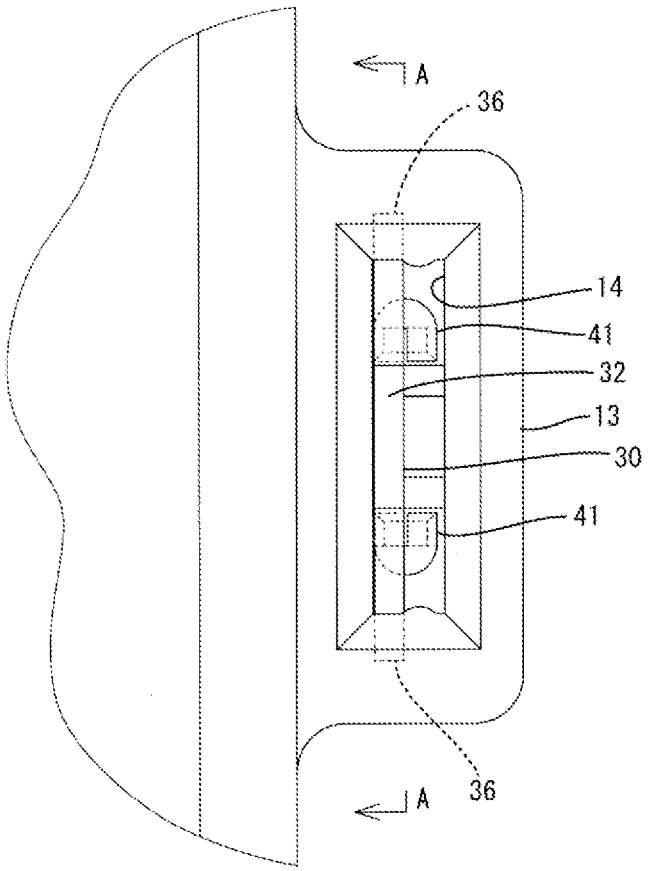
FIG. 2 is an enlarged plan view showing a state where a fixing member is mounted in a mounting portion of a housing.
Figure 3:
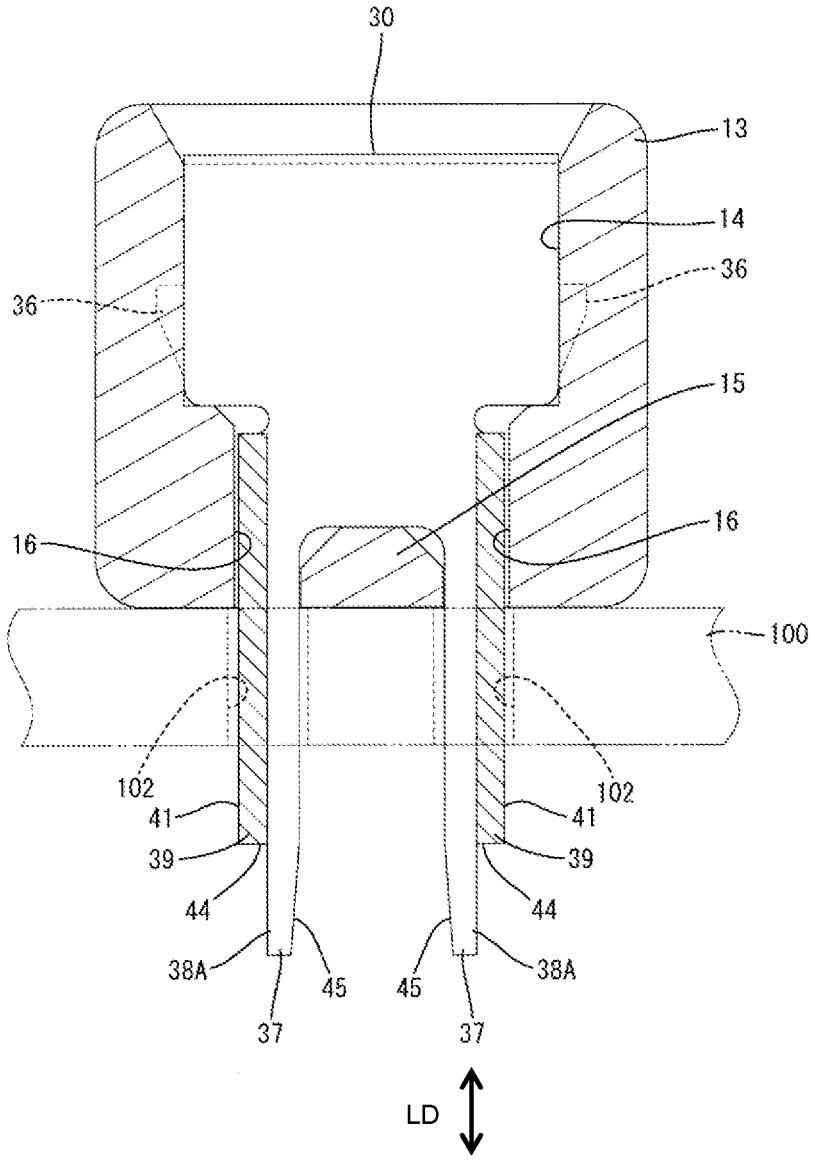
FIG. 3 is a section along A-A of FIG. 2.

A first embodiment of the invention is described with reference to FIGS. 1 to 10. A board connector of the first embodiment includes a housing 10, terminal fittings 90 and a pair of fixing members 30. Note that, in the following description, a right side in FIGS. 1 and 3 is referred to as a front and a vertical direction corresponds to that in FIGS. 1 and 3.

Figure 1:
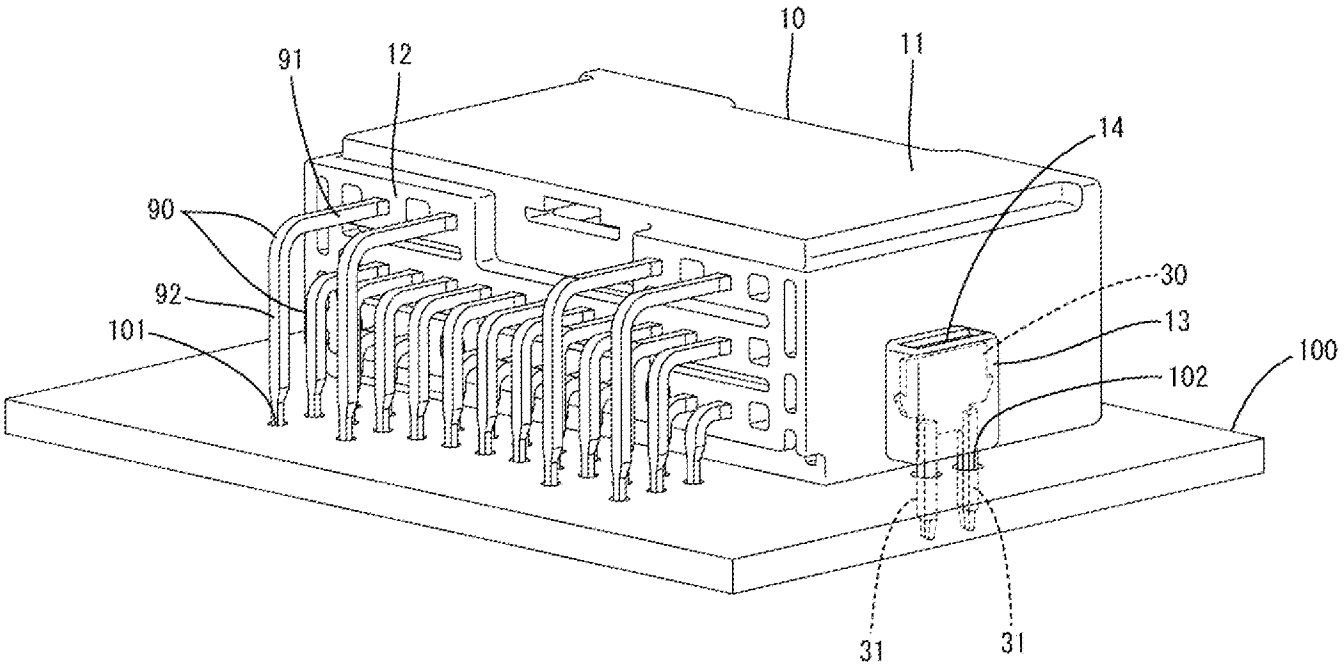
FIG. 1 is a perspective view of a board connector of a first embodiment of the invention.

The housing 10 is made e.g. of synthetic resin and includes, as shown in FIG. 1, a receptacle 11 in the form of a forwardly open rectangular or polygonal tube disposed on a surface of a circuit board 100. The receptacle 11 is laterally wide and the terminal fittings 90 are press-fit into a back wall 12. An unillustrated mating connector is fittable into the receptacle 11 from the front.

The terminal fitting 90 is made of conductive material such as metal and, as shown in FIG. 1, is substantially in the form of a square pin with a horizontal portion 91 extending in a front-back direction and a vertical portion 92 extending substantially perpendicularly down from the rear end of the horizontal portion 91. The horizontal portion 91 penetrates through the back wall 12 and a front end part thereof projects into the receptacle 11. The vertical portion 92 is exposed behind the receptacle 11 and a lower end part thereof is inserted into a through hole 101 of the circuit board 100 and fixed or electrically connected e.g. soldered. Note that the circuit board 100 has fixing holes 102, into which later-described board fixing portions 31 of the fixing members 30 are inserted and fixed by soldering.

Figure 8:
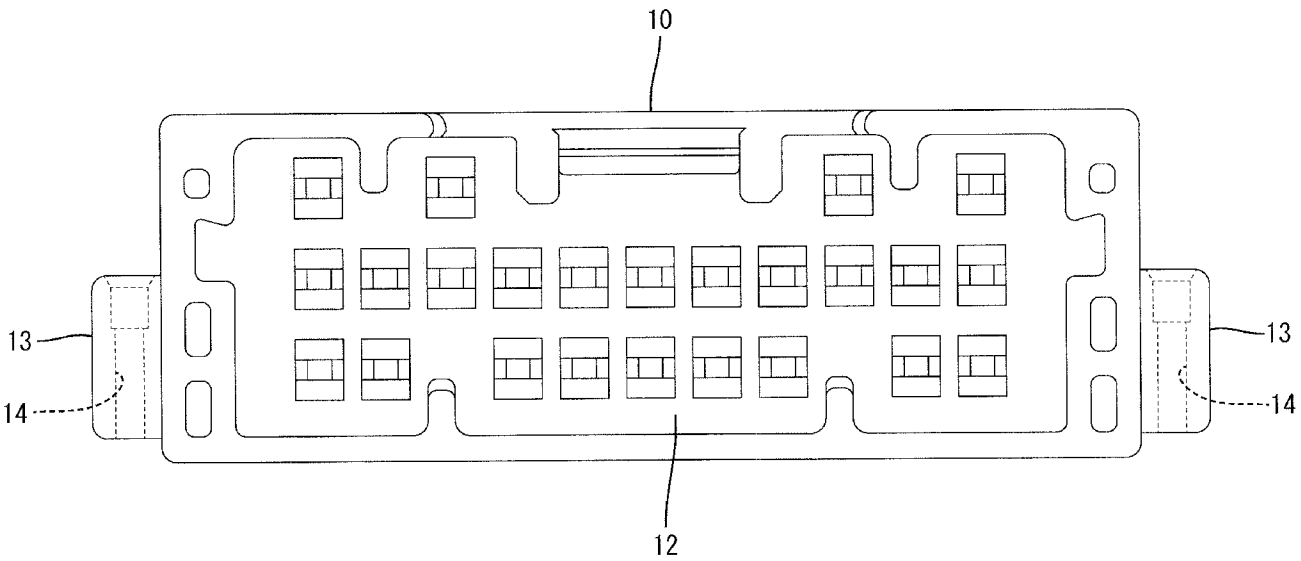
FIG. 8 is a front view of the housing.
Figure 9:
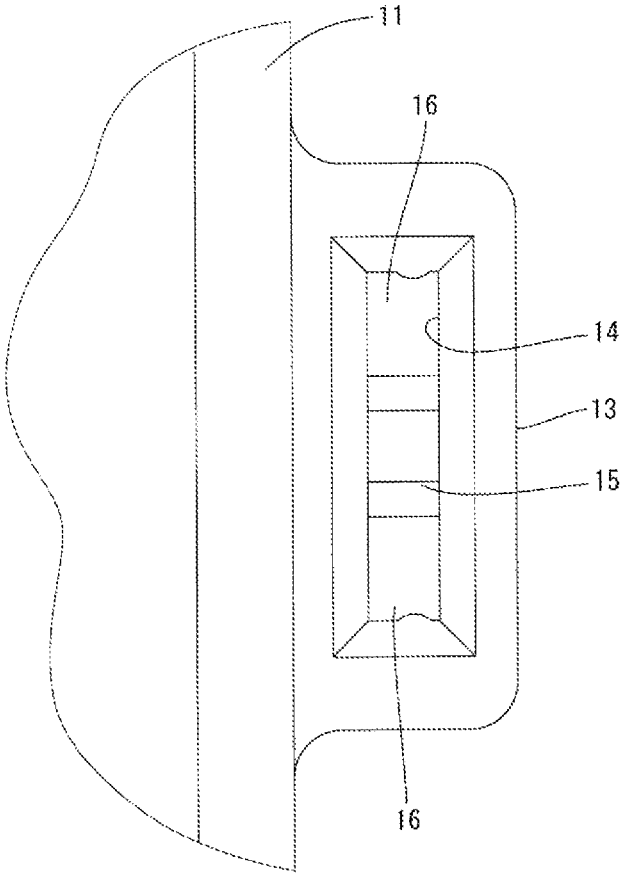
FIG. 9 is an enlarged plan view of the mounting portion of the housing.

As shown in FIG. 8, mounting portions 13 project on both left and right side surfaces of the housing 10. A mounting groove 14 is open on the upper surface of the mounting portion 13. As shown in FIG. 9, the mounting groove 14 defines a that is long in the front-back direction. As shown in FIG. 3, a solid portion 15 is provided in an inner lower end part of the mounting groove 14, and two insertion holes 16 vertically penetrate front and rear ends of the solid portion 15. The fixing member 30 is inserted into the mounting groove 14 from above and later-described coupled plate pieces 41 of the fixing member 30 are inserted into the insertion holes 16.

Figure 4:
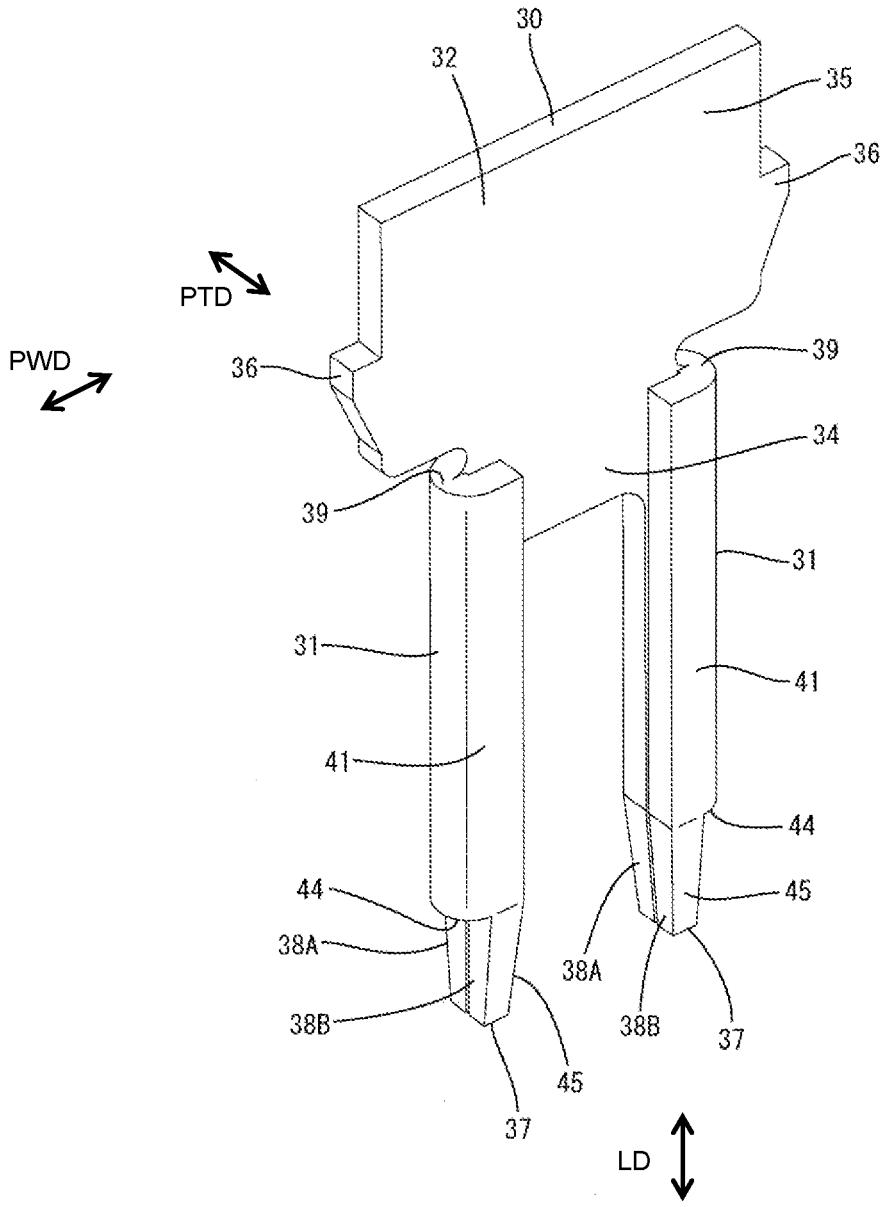
FIG. 4 is a perspective view of the fixing member.
Figure 5:
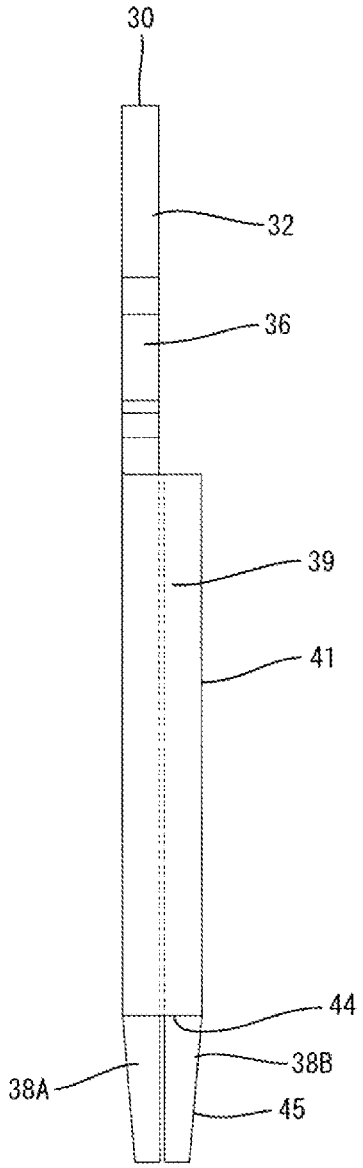
FIG. 5 is a front view of the fixing member.
Figure 7:
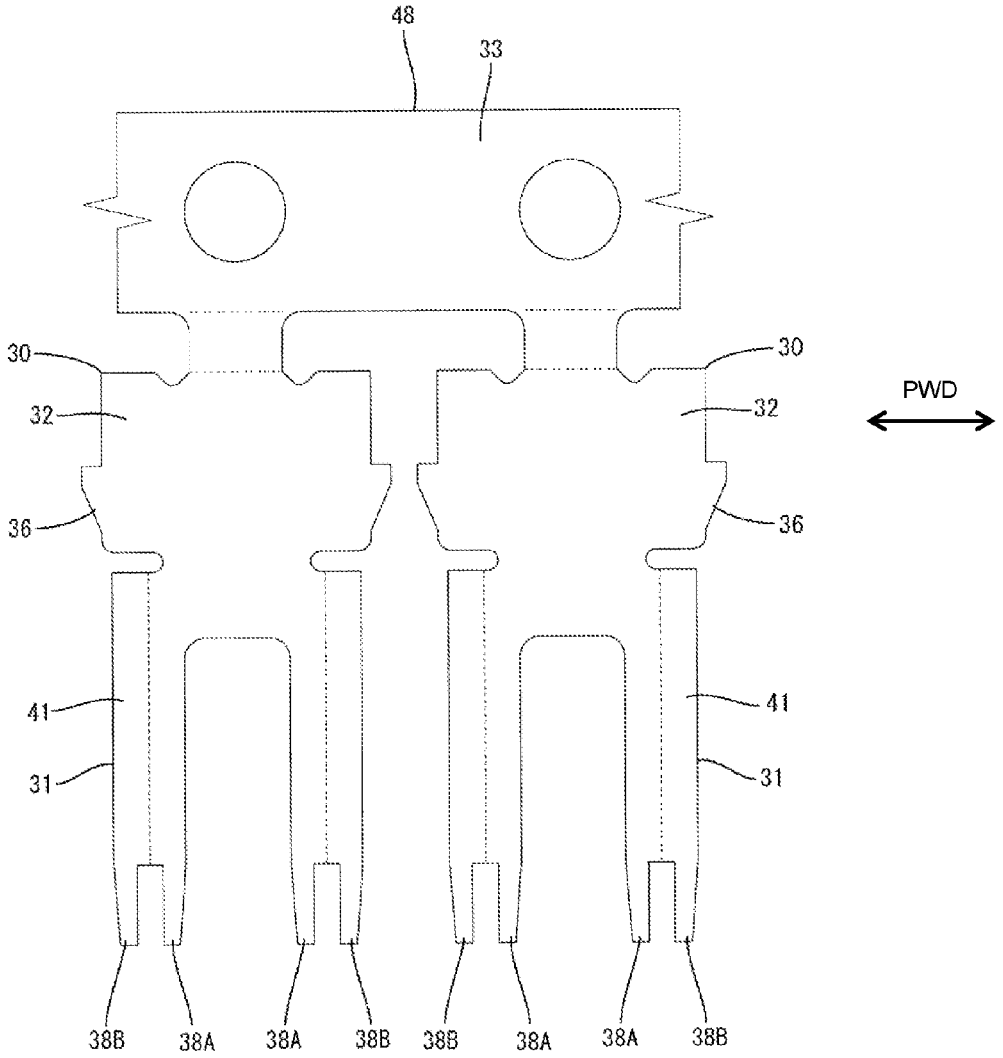
FIG. 7 is a development of fixing members coupled in a chain-like manner via a carrier.

The fixing member 30 is a plate made of metal, arranged so that plate surfaces face laterally and, as shown in FIG. 4, has vertically extending front and rear board fixing portions 31 and a housing fixing portion 32 bridging between the upper ends of the board fixing portions 31. As shown in FIG. 7, the fixing member 30 is supplied from a series terminal 48 in which plural fixing members 30 are coupled in a chain-like manner via a carrier 33.

As shown in FIG. 4, the housing fixing portion 32 is a flat plate and includes a lower portion 34 having a small width in the front-back direction and an upper portion 35 connected to the lower portion 34 via steps and having a larger width in the front-back direction. Two locking projections 36 protrude on both front and rear ends of the upper portion 35 of the housing fixing portion 32. As shown in FIGS. 2 and 3, when the fixing member 30 is inserted into the mounting groove 14, the lower end of the housing fixing portion 32 is stopped in contact with the solid portion 15 and the locking projections 36 bite into front and rear groove edges of the mounting groove 14 so that the fixing member 30 is retained and held in the mounting groove 14.

As shown in FIGS. 3 and 4, the board fixing portion 31 has a tip area 37 projecting on the underside of the circuit board 100 in a state inserted in the fixing hole 102. The board fixing portion 31 includes first and second plate pieces 38A, 38B facing each other in a plate thickness direction PTD (lateral direction in the case of the first embodiment).

The plate pieces 38A, 38B are formed over the entire width of the board fixing portion 31 in a plate width direction PWD (front-back direction) and over the entire length thereof in a vertical length direction LD, and are continuous with front and rear ends of the lower portion 34 of the housing fixing portion 32.

Figure 6:
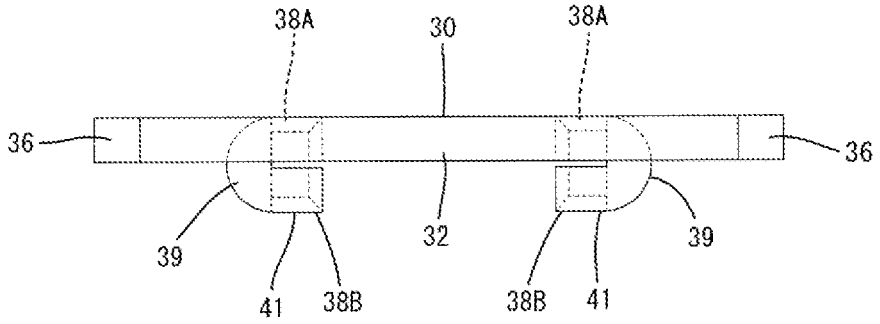
FIG. 6 is a plan view of the fixing member.
Figure 10:
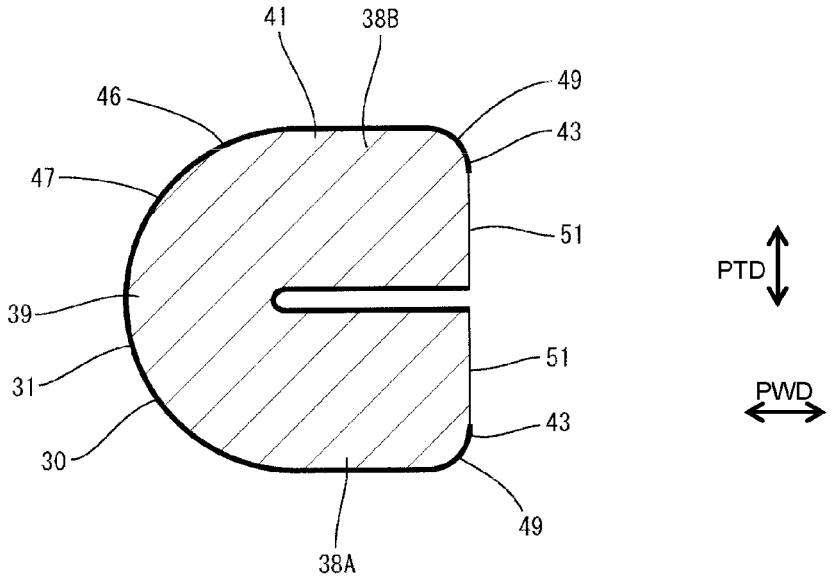
FIG. 10 is a section of a coupled plate piece formed with plating layers and plating drip layers.

The plate pieces 38A, 38B are coupled unitarily via a bend 39 except at the tip area 37. As shown in FIGS. 4, 6 and 10, the coupled plate piece 41 having a U-shaped cross-section is formed by the plate pieces 38A, 38B and the bend 39. The coupled plate piece 41 comprises the first plate piece 38A continuous with the upper portion 35 of the housing fixing portion 32 without any step, the second plate piece 38B facing the first plate piece 38A in the plate thickness direction PTD with a tiny clearance formed therebetween, and the bend 39 curved to have a substantially semicircular cross-section at the front or rear end of the fixing member 30 and connected to the plate pieces 38A, 38B. The inner end surfaces of the plate pieces 38A, 38B (surfaces facing the opposite plate pieces 38A, 38B between the board fixing portions 31) are exposed in the coupled plate piece 41, and plating drip layers 43 to be described later are formed on these inner end surfaces of the plate pieces 38A, 38B (see thick lines of FIG. 10).

As shown in FIG. 4, the tip area 37 includes no bend 39 and is composed only of the plate pieces 38A, 38B. The outer end surfaces of the plate pieces 38A, 38B also are arranged to be exposed, and the plating drip layers 43 are formed on the inner and outer end surfaces. A step 44 L-shaped in a side view is formed between the tip area 37 and the bent portion 39.

The tip area 37 is formed with a guide 45 for guiding an inserting into the fixing hole 102. The guide 45 is configured by parts of the inner end surface and left and right plate surfaces (both end surfaces in the plate thickness direction PTD) of the plate pieces 38A, 38B tapered toward the lower end. Note that, as shown in FIG. 3, the outer end surfaces of the plate pieces 38A, 38B of the tip area 37 are arranged along the vertical direction.

In manufacturing the fixing member 30, a metal plate is plated with tin, nickel, gold or the like to form plating layers 46 (see thick lines of FIG. 10) having a predetermined thickness on both plate surfaces of the metal plate. Subsequently, the metal plate is punched out into a predetermined shape by an unillustrated mold that moves from one surface (hereinafter, referred to as a punch-out surface 47) of the metal plate toward the other surface. Thus, the series terminal 48, in which fixing members 30 are arranged in a chain-like manner via the carrier 33, is obtained as shown in FIG. 7. The plate pieces 38A, 38B are arranged side by side in the plate width direction PWD (front-back direction) in a development shape of FIG. 7.

On end surfaces of the series terminal 48 (fracture surfaces intersecting with the plate surfaces), corners 49 continuous with the punch-out surface 47 are formed into curved surfaces (see FIG. 10). Further, the plating drip layers 43 are formed at positions of the end surfaces of the series terminal 48 including the corners 49. The plating drip layers 43 are formed to be continuous with the plating layers 46 by movements of the plating layers 46 following the unillustrated mold moving in a punch-out direction. Parts of the end surfaces of the series terminal 48 opposite the corners 49 are not continuous with the punch-out surface 47 and not formed with the plating drip layer 43. Note that the corners 49, the plating layers 46 and the plating drip layers 43 are not shown in figures other than FIG. 10 in the first embodiment.

Subsequently, the second plate piece 38B is folded toward the first plate piece 38A via the bend 39. In this way, the plate pieces 38A, 38B are arranged to face each other in the plate thickness direction PTD with the first plate piece 38A covered by the second plate piece 38B. As shown in FIG. 10, both plate surfaces of the first plate piece 38A and those of the second plate piece 38B are substantially parallel, and the plating layers 46 on these plate surfaces also are substantially parallel.

The end surface of the plate pieces 38A and 38B are arranged along the plate thickness direction PTD and are at the same position in the plate width direction PWD. The corners 49 of the plate pieces 38A, 38B and the plating drip layers 43 formed on the corners 49 are on opposite end parts of the plate pieces 38A, 38B in the plate thickness direction PTD. Thus, plural plating drip layers 43 are formed in the plate thickness direction PTD on the end surfaces of the board fixing portions 31. Intermediate parts of the plate pieces 38A, 38B in the plate thickness direction PTD define non-plated areas 51 between the plating drip layers 43.

Next, functions and effects of the first embodiment are described.

In assembling, the housing fixing portion 32 of the fixing member 30 is inserted into the mounting groove 14 of the mounting portion 13 of the housing 10 from above and the fixing member 30 is retained and held in the housing 10 by the locking action of the locking projections 36 located on both front and rear sides of the housing fixing portion 32 (see FIGS. 1 to 3). The two fixing members 30 are mounted respectively on left and right side surfaces of the housing 10.

Subsequently, the housing 10 is placed on the surface of the circuit board 100 and the board fixing portions 31 of the fixing members 30 are inserted into the fixing holes 102 of the circuit board 100 (see FIGS. 1 and 3). At this time, the guides 45 guide the tip areas 37 of the board fixing portions 31 smoothly into the fixing holes 102. When the board fixing portions 31 are inserted properly into the fixing holes 102, the coupled plate pieces 41 are arranged inside the insertion holes 16 of the mounting portions 13. Thereafter, soldering, such as flow soldering, is performed and the board fixing portions 31 are fixed to the circuit board 100 together with each terminal fitting 90.

Solder covers the outer peripheries of the board fixing portions 31 and satisfactorily adheres to the plating layers 46 and the plating drip layers 43 of the plate pieces 38A, 38B, but is difficult to adhere to the non-plated areas 51 of the plate pieces 38A, 38B. If the board fixing portion 31 is configured by one plate piece, only one plating drip layer is formed. Thus, a solder adhesion area is reduced. However, in the first embodiment, the board fixing portion 31 includes the plate pieces 38A, 38B and the plating drip layers 43 are formed respectively on the end surfaces of the plate pieces 38A, 38B. Thus, a large solder adhesion area is ensured.

As just described, according to the first embodiment, the board fixing portion 31 includes the plate pieces 38A, 38B, and the plating drip layers 43 are formed in the plate thickness direction PTD on the end surface of the board fixing portion 31. Thus, a large solder adhesion area can be ensured and solder wettability can be improved. As a result, a holding force of the fixing member 30 on the circuit board 100 is enhanced.

The plate pieces 38A, 38B are spaced from each other in the plate thickness direction PTD, so that solder satisfactorily adheres to the plating layers 46 formed on the plate surfaces of the plate pieces 38A, 38B facing each other via an inner clearance and solder wettability can be improved.

The plate pieces 38A, 38B are coupled unitarily via the bend 39 in the coupled plate piece 41. Thus, the number of components can be reduced, the plating layers 46 can be formed on the bent inner and outer surfaces of the bend 39 and solder wettability can be improved further.

The both plate pieces 38A, 38B are not provided on the upper portion 35 of the housing fixing portion 32. Thus, wasteful consumption of the metal plate can be prevented and cost can be suppressed to be low.

Figure 11:
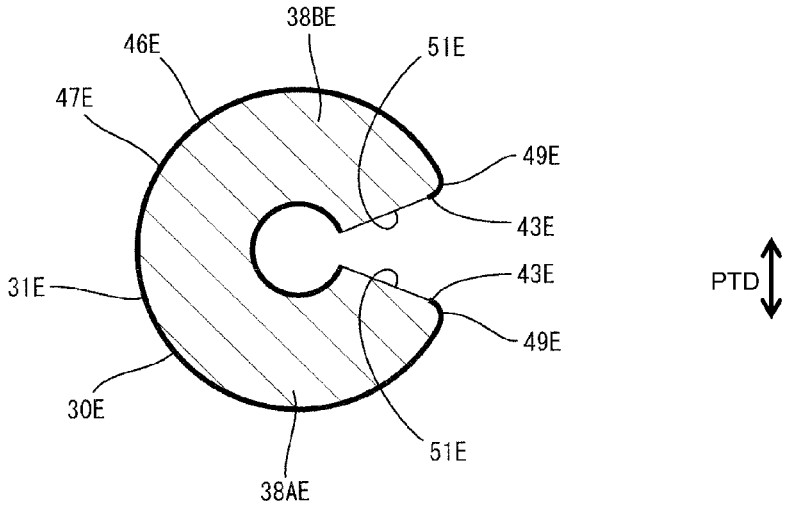
FIG. 11 is a section of a coupled plate piece formed with plating layers and plating drip layers in a second embodiment of the invention.

FIG. 11 shows a second embodiment of the invention. The second embodiment differs from the first embodiment in board fixing portions 31E of a fixing member 30E, but is similar to the first embodiment in other respects.

The board fixing portion 31E has a ring-shaped cross-section with ends, specifically a C-shaped cross-section, and is composed of plate pieces 38AE, 38BE having an arcuate cross-section and arranged to face in a plate thickness direction PTD. Plate surfaces (inner and outer surfaces) of the plate pieces 38AE, 38BE are curved arcuately without any step and end surfaces of the plate pieces 38AE, 38BE are tapered to be more separated toward a lateral or outer side. The plate surfaces of the plate pieces 38AE, 38BE on an outer peripheral side are a punch-out surface 47E and radially outer end parts of the end surfaces of the plate pieces 38AE, 38BE are corner parts 49E in the form of curved surfaces extending from the punch-out surface 47E.

One or more plating layers 46E are formed arcuately on the plate surfaces of the both plate pieces 38AE, 38BE, and plating drip layers 43E are formed to be continuous with the plating layer 46E on the outer periphery on the end surfaces of the plate pieces 38AE, 38BE. The plating drip layers 43E are formed on radially outer sides (including the corner parts 49) of the end surfaces of the plate pieces 38AE, 38BE, and radially inner sides of the end surfaces of the plate pieces 38AE, 38BE define non-plate areas 51E. Accordingly, the plating drip layers 43E formed on the end surfaces of the plate pieces 38AE, 38BE improves solder wettability, as in the first embodiment.

Figure 12:
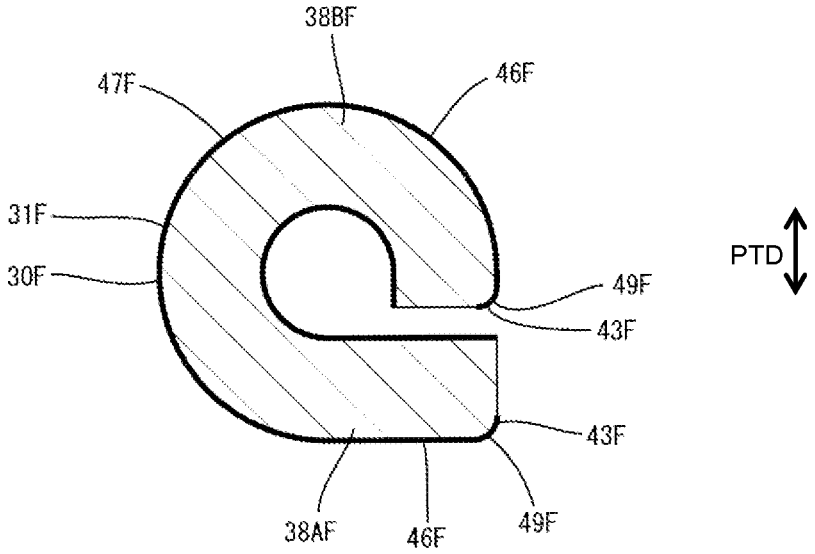
FIG. 12 is a section of a coupled plate piece formed with plating layers and plating drip layers in a third embodiment of the invention.

FIG. 12 shows a third embodiment of the invention. The third embodiment differs from the first embodiment in board fixing portions 31F of a fixing member 30F, but is similar to the first embodiment in other respects.

The board fixing portion 31F has a ring-shaped cross-section with ends, and comprises a first plate piece 38AF substantially straight along the front-back direction and a second plate piece 38BF having a substantially arcuate cross-section and folded along a curve from one end of the first plate piece 38AF. The end surface of the second plate piece 38BF is facing a plate surface of the first plate piece 38AF substantially in parallel with a tiny clearance formed therebetween and arranged along the front-back direction. The end surface of the first plate piece 38AF is arranged along the lateral direction. Outer plate surfaces of the plate pieces 38AF, 38BF are a punch-out surface 47F and outer end parts of the end surfaces of the plate pieces 38AF, 38BF are corner parts 49F in the form of curves extending from the punch-out surface 47F.

One or more plating layers 46F are formed straight on the plate surfaces of the first plate piece 38AF, and plating layers 46F are formed arcuately formed on the plate surfaces of the second plate piece 38BF. One or more plating drip layers 43F are formed to be continuous with the plating layers 46F at positions of outer sides of the end surfaces of the plate pieces 38AF, 38BF including the corner parts 49F. Accordingly, the plating drip layers 43F formed respectively on the end surfaces of the plate pieces 38AF, 38BF of the third embodiment improves solder wettability, as in the first embodiment.

Figure 13:
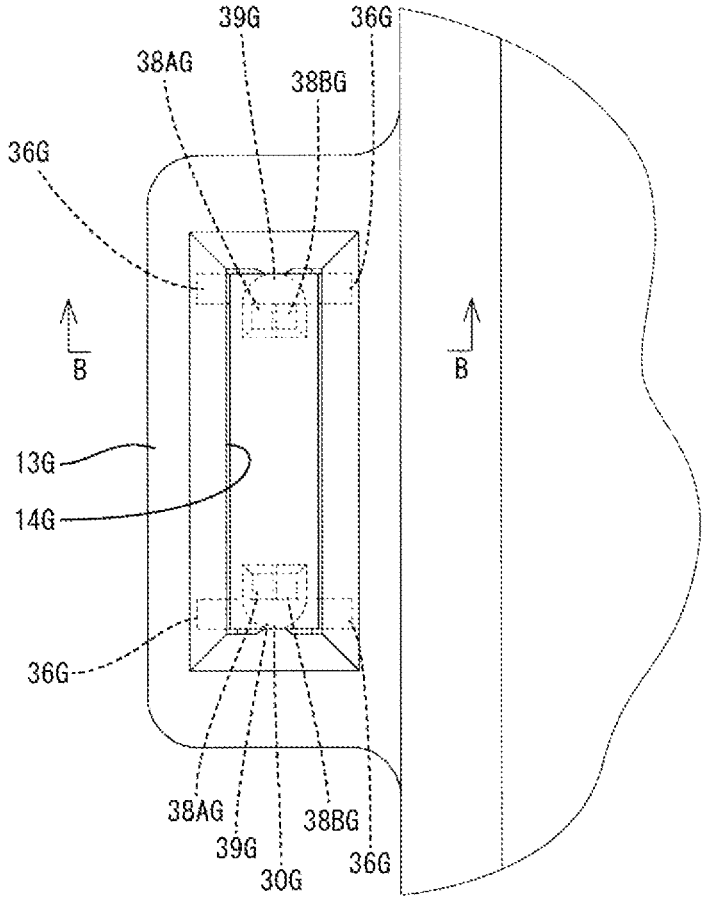
FIG. 13 is a section of a coupled plate piece formed with plating layers and plating drip layers in a fourth embodiment of the present invention.
Figure 14:
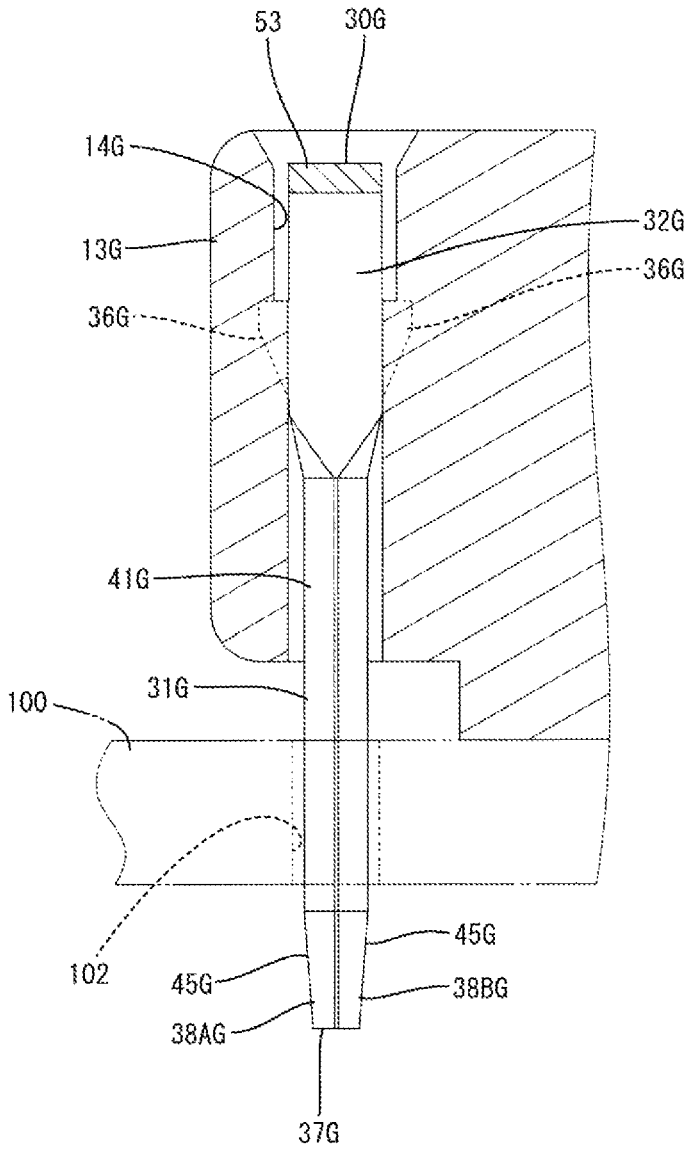
FIG. 14 is a section along B-B of FIG. 13.
Figure 15:
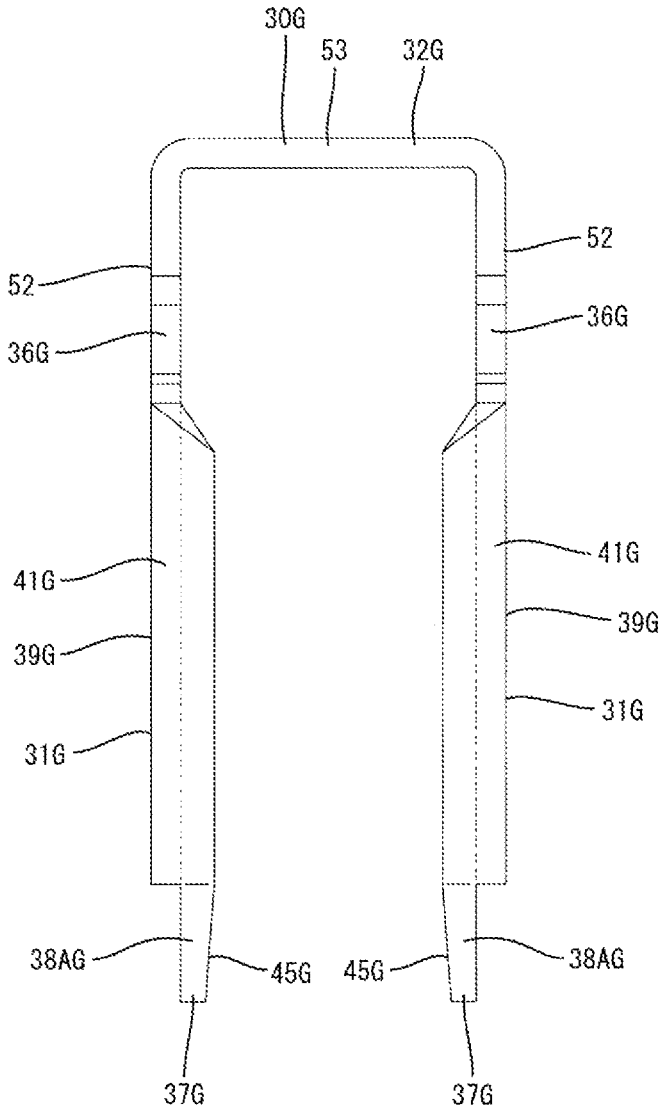
FIG. 15 is a side view of a fixing member.

FIGS. 13 to 15 show a fourth embodiment of the invention. The fourth embodiment differs from the first embodiment in a fixing member 30G, but is similar to the first embodiment in other respects.

In the case of the first embodiment, the fixing member 30 tends to be enlarged in the lateral direction by including the plate pieces 38A, 38B in the lateral direction. In view of this, the plate thickness of the fixing member 30 is made smaller than normal to suppress enlargement in the lateral direction. Processing can be difficult if only the board fixing portions 31 are thinned. More particularly, if the plate thickness of the entire fixing member 30 including the housing fixing portion 32 is thinned, the rigidity of the housing fixing portion 32 is reduced and there is a possibility of reducing a holding force of the fixing member 30 in the housing 10.

On the other hand, in the fourth embodiment, a sufficient holding force of the fixing member 30G in a housing 10 can be ensured regardless of a plate thickness of the fixing member 30G.

As shown in FIG. 15, the fixing member 30G is comprises two long and narrow legs 52 extending in the vertical direction and a bridging portion 53 bridging between the upper ends of the both legs 52. The bridging portion 53 and the legs 52 are in the form of strips wide in a plate thickness direction (lateral direction).

A housing fixing portion 32G is configured by the bridging portion 53 and upper end parts of the legs 52 and U-shaped in a side view. Two locking projections 36G protrude in the lateral direction on left and right edge parts of the upper or distal end parts of the legs 52. As shown in FIGS. 13 and 14, when the fixing member 30G is inserted into a mounting groove 14G of a mounting portion 13G of the housing 10, the locking projections 36G bite into left and right edges of the mounting groove 14G so that the fixing member 30G is retained and held in the mounting groove 14G. Note that an opening width of the mounting groove 14G in the lateral direction is made slightly larger than that of the mounting groove 14 of the first embodiment to correspond to a plate width of the housing fixing portion 32G in the lateral direction.

A board fixing portion 31G is configured by a part of the leg 52 excluding the upper end part and includes two plate pieces 38AG, 38BG facing each other in the lateral direction. A part of the board fixing portion 31G excluding a tip area 37G on a tip side is formed into a coupled plate piece 41G provided with a bend 39G for coupling the plate pieces 38AG, 38BG. The bend 39G is connected to the housing fixing portion 32G and the plate pieces 38AG, 38BG are bent at both left and right sides of the bend 39G such that plate surfaces thereof face each other. Unillustrated plating layers are formed on the plate surfaces of the plate pieces 38AG, 38BG and the plate surfaces of the bend 39G, and unillustrated plating drip layers are formed on outer end parts of the end surfaces of the plate pieces 38AG, 38BG. These plating layers and plating drip layers have substantially the same structures as in the first embodiment.

Note that, in development shapes of the plate pieces 38AG, 38BG before bending, a width of the coupled plate piece 41G in the lateral direction is suppressed to be equal to or smaller than that of the housing fixing portion 32G in the lateral direction (maximum width of a part corresponding to the locking projections 36G) so that a material is not wasted.

The tip area 37G has no bent portion 39G and the plate pieces 38AG, 38BG continuously hang down. The inner end surfaces (surfaces of the plate pieces 38AG, 38BG facing each other between the legs 52) and the left and right plate surfaces of the plate pieces 38AG, 38BG are tapered and constitute guide portions 45G. The structure and functions of the tip areas 37G are as in the first embodiment.

In the case of the fourth embodiment, the housing fixing portion 32G is in the form of a strip wide in the lateral direction and four locking projections 36G provided on the housing fixing portion 32G respectively bite into the left and right edges of the mounting groove 14G. Thus, a sufficient holding force of the fixing member 30G in the housing 10 can be ensured.

Figure 16:
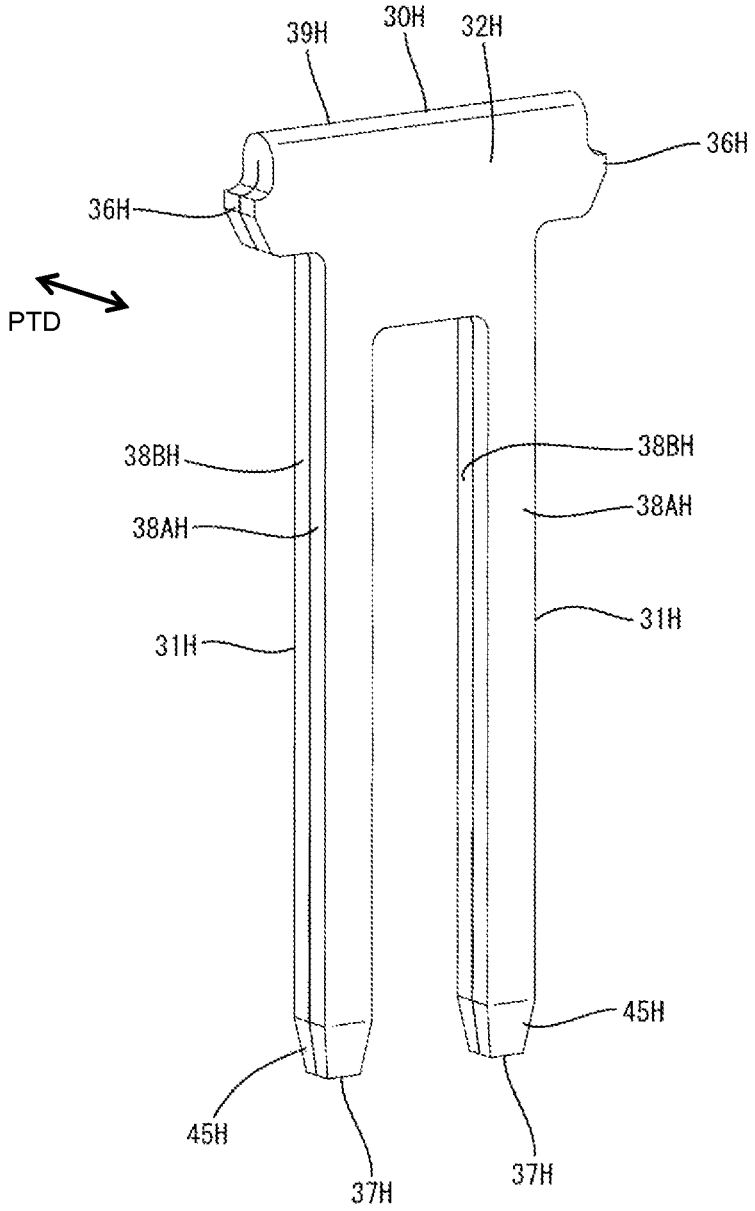
FIG. 16 is a perspective view of a fixing member of a fifth embodiment.
Figure 17:
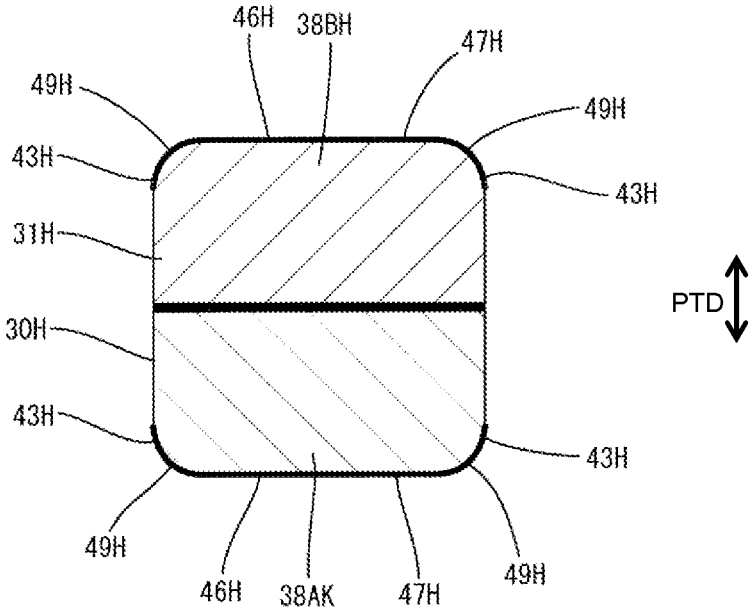
FIG. 17 is a section of both plate pieces formed with plating layers and plating drip layers.

FIGS. 16 and 17 show a fifth embodiment of the invention. The fifth embodiment differs from the first embodiment in a fixing member 30H, but is similar to the first embodiment in other respects.

The fixing member 30H is folded to overlap entirely in the lateral direction (plate thickness direction PTD). Specifically, the fixing member 30H is arranged so that plate surfaces face in the lateral direction, and has two board fixing portions 31H extending vertically and a housing fixing portion 32H bridging between the upper ends of the board fixing portions 31, and doubly constituted by plate pieces 38AH, 38BH facing each other in the plate thickness direction PTD while being held in close contact. A bend 39H having a substantially semicircular cross-section is provided on the upper end of the housing fixing portion 32H, and the plate pieces 38AH, 38BH are coupled unitarily via the bend 39H. The plate pieces 38AH, 38BH specify the outer shapes of the board fixing portions 31H and the housing fixing portion 32H and identically shaped.

Two locking projections 36H protrude on both front and rear ends of the housing fixing portion 32H and are configured to bite into and be locked to front and rear edges of the mounting groove 14. Tip areas 37H are provided on tip sides of the board fixing portions 31H and tapered guide portions 45H are provided on left and right plate surfaces and front and rear end surfaces of the both plate pieces 38AH, 38BH. The board fixing portions 31H are smoothly guided into the fixing holes 102 of the circuit board 100 by the guide portions 45H.

As shown in FIG. 17, plating layers 46H are formed along the front-back direction on the plate surfaces of the plate pieces 38AH, 38BH. Outer plate surfaces (plate surfaces opposite to those facing each other) are punch-out surfaces 47H and the plating layers 46H formed on the punch-out surfaces 47H are arranged to be exposed to outside.

Outer end parts of the end surfaces of the plate pieces 38AH, 38BH are corner parts 49H in the form of curved surfaces continuous with the punch-out surfaces 47H. Further, plating drip layers 43H are formed on outer end parts of the end surfaces of the plate pieces 38AH, 38BH. The plating drip layers 43H cover areas including the corner parts 49H.

According to the fifth embodiment, the board fixing portion 31H comprises the two plate pieces 38AH, 38BH. Two plating drip layers 43H are formed on each of the plate pieces 38AH, 38BH, i.e. a total of four plating drip layers 43H are formed, and each plating drip layer 43H can function as a solder adhesion area. Thus, solder wettability can be improved.

Figure 18:
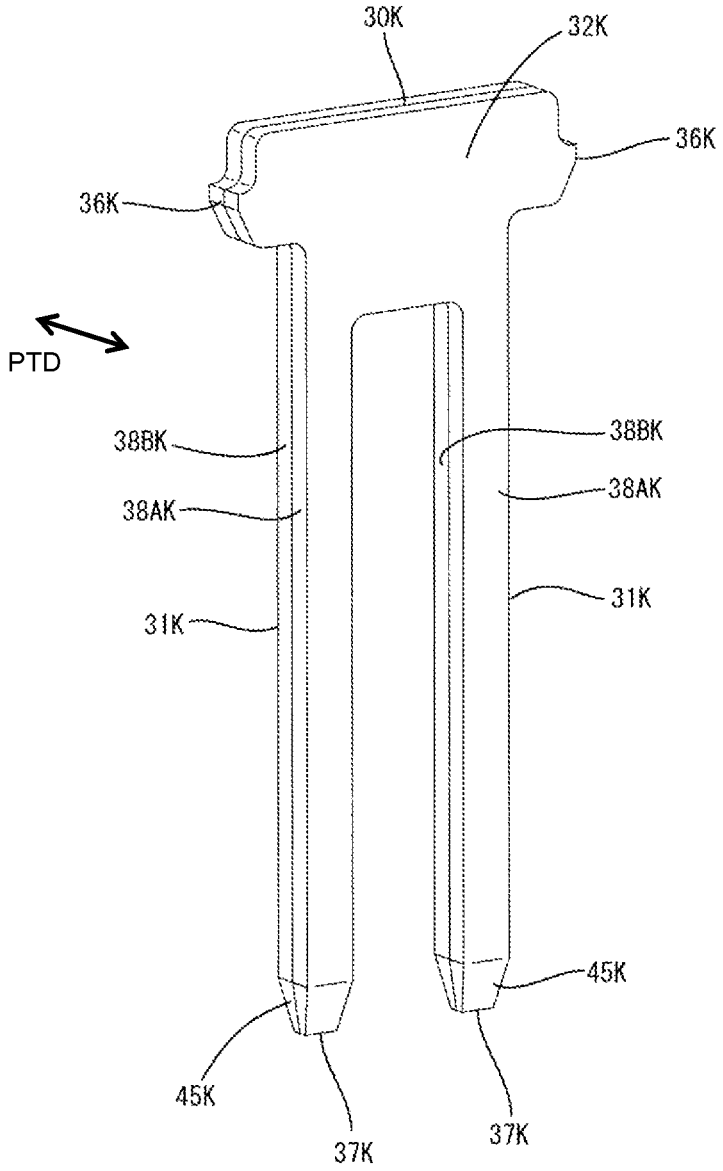
FIG. 18 is a perspective view of a fixing member of a sixth embodiment.
Figure 19:
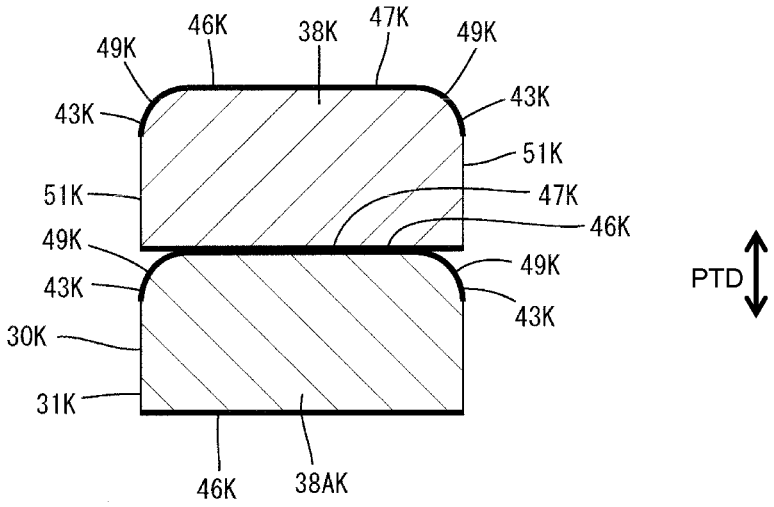
FIG. 19 is a section of both plate pieces formed with plating layers and plating drip layers.

FIGS. 18 and 19 show a sixth embodiment of the invention. The sixth embodiment also differs from the first embodiment in a fixing member 30K, but is similar to the first embodiment in other respects.

The fixing member 30K is configured by doubling pairs of plate pieces 38AK, 38BK separate from each other in a plate thickness direction PTD. Specifically, the fixing member 30K has a side view shape similar to that of the fifth embodiment, is composed of a housing fixing portion 32K including two locking projections 36K on both front and rear sides and board fixing portions 31K including guide portions 45K on tip areas 37K on a lower end side, and is doubly constituted by the plate pieces 38AK, 38BK facing each other in the plate thickness direction PTD. Nothing corresponding to the bend 39H of the fifth embodiment is present on the upper end of the housing fixing portion 32K, and the plate pieces 38AK, 38BK are separable from each other.

Plating layers 46K are formed along the front-back direction on plate surfaces of the plate pieces 38AK, 38BK. Here, the plate pieces 38AK, 38BK are overlapped so that punch-out surfaces 47K face toward one side (upper side of FIG. 19) in the plate thickness direction PTD. Thus, corners 49K in the form of curved surfaces continuous with the punch-out surfaces 47K are formed on one end part and an intermediate part in the plate thickness direction PTD of each of end surfaces of the assembly of the both plate pieces 38AK, 38BK, and plating drip layers 43K are formed in places including the corner parts 49K.

According to the sixth embodiment, the plating drip layers 43K are formed on the one end part and the intermediate part in the plate thickness direction PTD of each of the end surfaces of the assembly of the plate pieces 38AK, 38BK, a length of non-plated areas 51K formed between the plating drip layers 43K in the plate thickness direction PTD can be made shorter as compared to the case where the plating drip layers 43K are formed on both end parts of the assembly of the plate pieces 38AK, 38BK in the plate thickness direction PTD (see FIG. 17). As a result, the interruption of the solder adhesion areas can be made shorter and solder wettability can be further improved.

Other embodiments are briefly described below.

The board fixing portion may be arranged substantially along the surface of the circuit board without being inserted into the fixing hole of the circuit board. In this case, solder on the circuit board has only to be wetted to the plating drip layers formed on the end surfaces of the plate pieces.

The fixing member may be a flat plate such as a rectangular plate and may have a substantially L-shaped cross-section by a board fixing portion and a housing fixing portion.

Three or more plate pieces may be arranged to face each other in the plate thickness direction.

In the second and third embodiments, the entire fixing member may be rounded into a pin.

In the fifth embodiment, the both plate pieces may face each other via a clearance.

REFERENCE SIGNS

10 . . . housing
30, 30E, 30F, 30G, 30H, 30K . . . fixing member
31, 31E, 31F, 31G, 31H, 31K . . . board fixing portion
32, 32G, 32H, 32K . . . housing fixing portion
38AE, 38BE, 38AF, 38BF, 38AG, 38BG, 38AH, 38BH, 38AK, 38BK . . . plate piece
39, 39G, 39H . . . bent portion
43, 43E, 43F, 43H, 43K . . . plating drip layer
46, 46E, 46F, 46H, 46K . . . plating layer
90 . . . terminal fitting
100 . . . circuit board

What is claimed is:

1. A board connector, comprising:

a housing into which at least one terminal fitting is to be mounted, and a substantially plate-like fixing member to be mounted in the housing and including at least one board fixing portion to be fixed to a circuit board by solder, wherein:

at least the board fixing portion of the fixing member includes a plurality of plate pieces arranged to substantially face each other in a plate thickness direction; and plating layers are formed on plate surfaces of the plate pieces and plating drip layers substantially continuous with the plating layers are formed on end surfaces of the plate pieces intersecting the plate surfaces.

2. The board connector of claim 1, wherein the plate pieces are arranged at a distance from each other in the plate thickness direction.

3. The board connector of claim 1, wherein the plate pieces are coupled integrally or unitarily via a bend.

4. The board connector of claim 1, wherein the plate pieces are not provided in a part of the fixing member to be mounted in the housing.

5. The board connector of claim 1, wherein the plating drip layers are formed to be substantially continuous with the plating layers formed on the plate surfaces of the plate pieces substantially facing toward one side in the plate thickness direction.

* * * * *